US006503325B1

(12) United States Patent
Hess

(10) Patent No.: US 6,503,325 B1
(45) Date of Patent: Jan. 7, 2003

(54) DEVICE AND METHOD FOR APPLYING A COATING MEDIUM ONTO A MOVING SURFACE

(75) Inventor: Harald Hess, Grünkraut (DE)

(73) Assignee: Voith Sulzer Papiertechnik Patent GmbH, Heidenheim (DE)

( * ) Notice: Subject to any disclaimer, the term of this patent is extended or adjusted under 35 U.S.C. 154(b) by 0 days.

(21) Appl. No.: 09/563,183

(22) Filed: May 2, 2000

Related U.S. Application Data

(62) Division of application No. 09/301,194, filed on Apr. 28, 1999, now Pat. No. 6,248,407.

(30) Foreign Application Priority Data

May 7, 1998 (DE) ..... 198 20 432

(51) Int. Cl.[7] ..... B05C 5/00

(52) U.S. Cl. ..... 118/325; 118/302; 118/58; 118/65

(58) Field of Search ..... 118/58, 325, 634, 118/62, 65, 302, 257, 410

(56) References Cited

U.S. PATENT DOCUMENTS

| | | | | |
|---|---|---|---|---|
| 1,837,702 A | | 12/1931 | Canfield | |
| 3,518,964 A | * | 7/1970 | Nagler | 118/65 |
| 3,678,888 A | | 7/1972 | Davies et al. | 118/48 |
| 3,782,330 A | * | 1/1974 | Kanda | 118/325 |
| 4,132,189 A | * | 1/1979 | Greve et al. | 118/325 |
| 4,258,649 A | | 3/1981 | Dunn, Jr. et al. | 118/61 |
| 4,520,047 A | | 5/1985 | Hillemanns et al. | 427/331 |
| 4,810,432 A | * | 3/1989 | Kisler | 264/22 |
| 4,820,380 A | | 4/1989 | O'Callaghan et al. | 162/135 |
| 4,836,137 A | | 6/1989 | Heine et al. | 118/663 |
| 4,944,960 A | | 7/1990 | Sundholm et al. | 427/27 |
| 4,946,101 A | | 8/1990 | Winheim | 239/8 |
| 5,286,348 A | | 2/1994 | Perin | 162/262 |
| 5,332,458 A | | 7/1994 | Wallick | 156/210 |
| 5,622,599 A | | 4/1997 | Sproule et al. | 162/186 |
| 5,628,460 A | | 5/1997 | Chastang et al. | 239/433 |
| 5,633,044 A | | 5/1997 | Linnonmaa | 427/421 |
| 5,849,321 A | * | 12/1998 | Linnonmaa | 118/325 |
| 6,187,142 B1 | * | 2/2001 | Heinzmann et al. | 118/257 |
| 6,203,858 B1 | * | 3/2001 | Plomer | 118/325 |
| 6,309,463 B1 | * | 10/2001 | Hess et al. | 118/302 |

FOREIGN PATENT DOCUMENTS

| | | | |
|---|---|---|---|
| DE | 1 60 636 | 8/1941 | |
| DE | 885 534 | 6/1953 | |
| DE | 2 38 352 | 6/1964 | |
| DE | GM 76 15 651 | 6/1977 | B41F/23/02 |
| DE | 33 01 909 C1 | 10/1984 | B41F/31/08 |
| DE | 36 11 729 A1 | 10/1987 | B05B/5/08 |
| DE | 41 16 707 A1 | 11/1992 | B41F/31/02 |
| DE | 42 35 696 A1 | 4/1993 | B05D/1/00 |
| DE | 42 30 334 A1 | 2/1994 | B41F/31/02 |
| DE | 43 09 647 A1 | 9/1994 | B05C/11/06 |
| DE | 43 14 077 A1 | 11/1994 | B05C/1/14 |
| DE | 44 25 655 A1 | 1/1996 | B05B/5/025 |
| DE | 197 51 972 A1 | 6/1998 | B41F/23/06 |
| EP | 0 157 949 | 10/1985 | D21D/3/00 |
| EP | 0 670 004 B1 | 9/1993 | D21H/23/60 |
| EP | 0 435 904 B1 | 3/1994 | B05B/7/00 |
| EP | 0 678 344 A2 | 10/1995 | B05D/1/02 |
| GB | 1100725 | 1/1968 | B05C/1/06 |

(List continued on next page.)

*Primary Examiner*—Richard Crispino
*Assistant Examiner*—Yewebdar T Tadesse
(74) *Attorney, Agent, or Firm*—Taylor & Aust, P.C.

(57) ABSTRACT

In a method of application of a coating medium by use of a spray device onto a moving surface, which in the direct application method is the surface of a material web, specifically a paper or cardboard web, an atmosphere of back-moistening and/or moistening medium for the atomized coating medium is maintained in the area of the spray device.

8 Claims, 2 Drawing Sheets

FOREIGN PATENT DOCUMENTS

| | | | |
|---|---|---|---|
| WO | WO 93/18228 | 9/1993 | ..... D21H/23/50 |
| WO | WO 94/11116 | 11/1993 | ..... B05C/11/02 |
| WO | WO 94/11116 | 5/1994 | ..... B05C/11/02 |
| WO | WO 96/30127 | 10/1996 | ..... B05B/15/12 |
| WO | WO 97/13035 | 4/1997 | ..... D21H/23/50 |
| WO | WO 97/13036 | 4/1997 | ..... D21H/23/50 |
| WO | WO 97/14508 | 4/1997 | ..... B05B/15/12 |

* cited by examiner

DEVICE AND METHOD FOR APPLYING A COATING MEDIUM ONTO A MOVING SURFACE

CROSS REFERENCE TO RELATED APPLICATIONS

This is a division of U.S. patent application Ser. No. 09/301,194, entitled "DEVICE AND METHOD FOR APPLYING A COATING MEDIUM ONTO A MOVING SURFACE", filed Apr. 28, 1999, now U.S. Pat. No. 6,248,407.

BACKGROUND OF THE INVENTION

1. Field of the Invention

The present invention relates to the application of a coating medium by use of a spray device onto a moving surface, whereby in the direct application method the moving surface is the surface of a material web, specifically a paper or cardboard web, and in the indirect application method is the surface of a transfer element from which the coating medium is transferred to the material web.

2. Description of the Related Art

Devices for application of a coating medium by use of a spray device onto a moving surface are already known from EP 0 670 004 B1, WO 94/11116 and EP 0 435 904 B1. Generally, the objective of this type of spray applicator device is to apply the coating medium with as little excess as possible, and in the best case scenario even with no excess at all (1:1 application) to the moving surface. In the application methods described in the above referenced publications, the coating medium is atomized by use of air and is applied to the moving surface. After the coating medium has settled there, the carrier air is suction removed from the application area through channels surrounding the spray apparatus. Even with very low application base weights, very large volumes of air must be supplied to and suction removed from the moving surface in a given time period. It has been demonstrated in practice that, from a quality point of view, only an insufficiently satisfactory coating result can be achieved with the previously known coating methods. Despite subsequent smoothing of the applied layer, the layer still displays an uneven structure as well as a rough, sandpaper-like surface.

SUMMARY OF THE INVENTION

Faced with these challenges, the current invention provides a spray coating method with which coating layers having more uniform and smooth surfaces may be achieved.

In the area of the spray device, an atmosphere of a back moistening and/or moistening medium for atomized coating medium is maintained. The back moistening and/or moistening medium may be the vapor of a liquid which may also act as a carrier liquid for the coating medium which, prior to spraying, is liquid or viscous, for example steam, toluol vapor, etc. In the following explanation of the current invention, only water vapor, that is, steam, will be referred to as a back moistening and/or moistening medium for reasons of simplifying the discussion. However, this does not imply that the scope of protection for the method according to the invention is limited to the usage of water vapor.

The maintenance of a steam atmosphere in the area of the spray device is advantageous in several respects for achieving a high quality coating result. On the one hand, the atomized coating medium moves in an atmosphere from the spray device to the moving surface which prevents excessive escape of moisture from the coating medium droplets and/or particles, thereby preventing drying out at least the surface of these droplets and/or particles. Because of this, the droplets and/or particles maintain their liquidity and are more able to flow after coming into contact with the moving surface, which contributes to a smoother surface of the applied coating layer.

On the other hand, it is not necessary to suck the steam atmosphere from the application area. It is merely necessary to compensate for steam losses which are caused possibly by precipitation of the steam as moisture onto the moving surface or onto the coating layer, by supplying fresh steam. This will largely prevent turbulence in the application area, such as is caused in the state of the art equipment by air supply and by air suction removal and will have a positive effect upon the uniformity of the layer application.

The previously addressed precipitation of steam as moisture onto the coating layer has no negative effects, since the water in the coating layer is present anyway in the form of carrier liquids for the coating medium. On the contrary, the precipitated moisture improves the flowability characteristics of the coating medium in the applied layer, resulting in a smoother surface. The same also applies to all other carrier liquids commonly used in coating mediums, and their vapor, for example toluol and toluol vapor.

It must be emphasized that, in the previously referred to sense, the term "drying" is to be understood as the escape of carrier liquid from the coating medium in the form of vapor, and the term "back moistening" is to be understood as the supply of carrier liquid from the steam atmosphere into the coating medium droplets and/or particles. In the best case scenario, the nature of the steam atmosphere in the area of the spray device provides a balance between drying and back moistening for the atomized coating medium.

With the method of the current invention, powdery coating mediums can be converted. The steam in this instance condensates on the coating medium particles while they travel from the spray device to the moving surface, thereby moistening them, so that after making contact with the moving surface they are able to flow and produce a smooth coating layer.

In a further development of the invention, the spray device is located in a chamber into which the back moistening and/or moistening medium is fed by a supply device provided for this purpose.

The spray device may, for example, take the form of a single substance spray device. It is, however, also possible to utilize a two-substance spray device within the scope of the method according to the invention, which sprays the coating medium by use of steam. The steam used for atomization may, for example, alone serve in the formation of the steam atmosphere in the area of the spray device. It is, however, also possible to supply additional steam to the area of the spray device.

Depending upon the boundary conditions of each individual application, for example the consistency and structure of the coating medium that is to be sprayed, two-substance spray devices working according to the internal mixing principle, as well as the external mixing principle, may be utilized.

A rotary spray device may also be utilized whereby the coating medium is sprayed by a high speed rotary spray element by the effect of centrifugal forces acting upon it. The coating medium sprayed in this manner can be supplied to the moving surface, for example, by use of the steam. A ring slot-type steam outlet opening may, for example, be provided around the rotary spray element, from which the steam is emitted in the shape of a cone of a predetermined cone angle. A ring-shaped arrangement of several individual steam outlet openings may also be used.

In addition, or as an alternative, electrostatic forces may also be utilized in order to bring the atomized coating medium to the moving surface. For example, the rotary spray device may be connected to a predetermined electrical potential, so that the atomized coating medium droplets and/or particles leave the spray device electrically charged. The moving surface, or an element assigned to the moving surface, can be connected to ground potential so that an attractive force is exerted upon the charged droplets and/or particles.

Finally, a device may be provided prior to the area of application, viewed in direction of travel of the moving surface, which, by utilizing steam, removes an air boundary layer from the moving surface which carries it. This facilitates the coverage of the entire surface of the moving web/surface with coating medium, which in turn has a positive effect on the coverage quality of the applied coating layer.

If steam is supplied to the moving surface prior to the spray device when viewed in direction of travel, and is then suction removed after the spray device when viewed in direction of travel, a movement component may be imparted to the atomized coating medium which would favor its deposit on the moving surface in a way maintaining a smooth coating layer. The steam volumes required for this, compared to the previously discussed unfavorable air volumes, are considerably less. Thus, no deterioration in the uniformity of the coating result occurs.

Another aspect of the invention relates to a device for the application of a coating medium by use of a spray device onto a moving surface. Regarding the constructive details, design variations, and the advantages that are achievable with this device, reference can be made to the previous discussion regarding the coating method in accordance with the invention.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
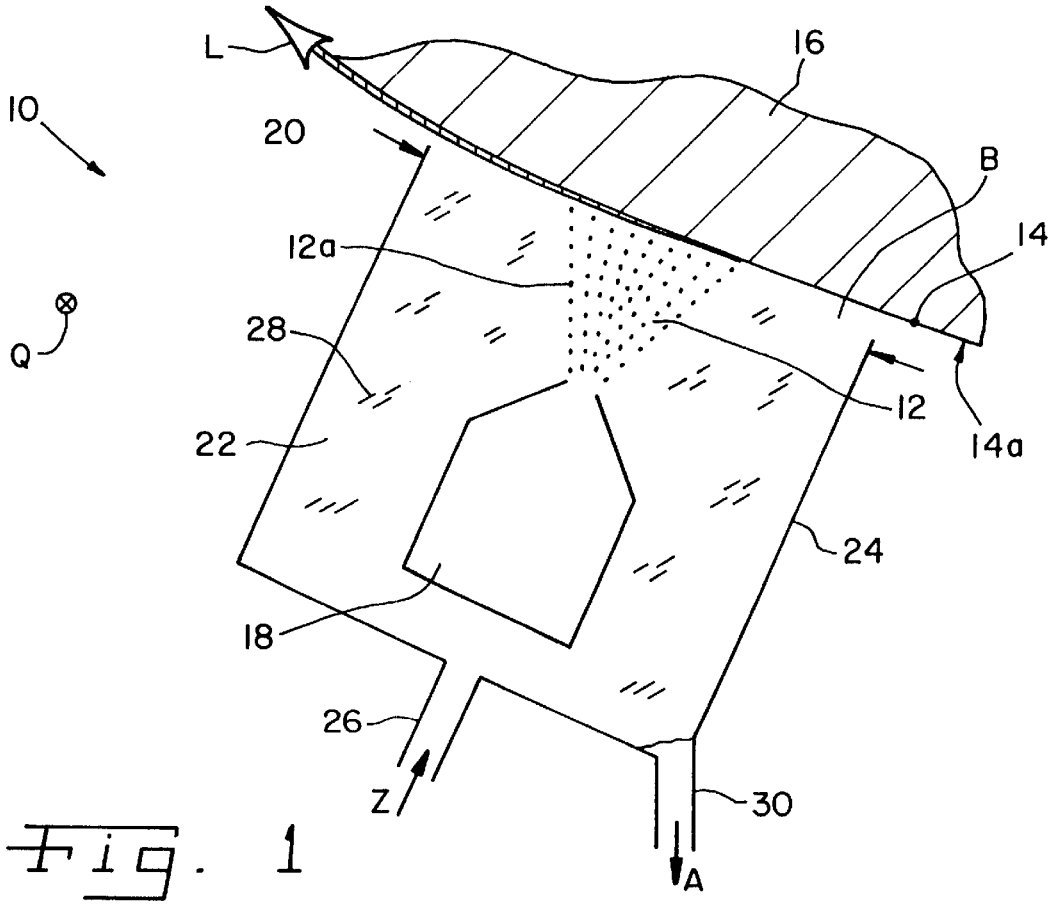
FIG. 1 is a schematic side view of one embodiment of an applicator device in accordance with the invention.

Referring now to the drawings and particularly to FIG. 1, there is shown an applicator device in accordance with the invention, generally identified with 10. The applicator device 10 serves to apply a coating medium 12 to the surface 14*a* of a material web 14 which, in the area of the applicator unit 10 is led around a support roll 16. As a result of rotation of the support roll 16, the material web 14 travels past the applicator device 10, in the direction of arrow L. The applicator device 10 includes a spray nozzle 18 which releases the coating medium 12 in atomized form, that is, in the form of coating medium droplets and/or particles 12*a*, to the material web 14. The droplets and/or particles 12*a* making contact with the material web surface 14*a*, flow and form a coating layer 20 on the material web surface 14*a*.

In the embodiment of the invention according to FIG. 1, the spray nozzle 18 is located in a chamber 22, which is enclosed by a housing 24. The housing 24 is open toward the support roll 16 and is located from it at a small distance such that the material web 14 enters the area B of chamber 22 without making contact and also exits this area B complete with coating layer 20 without making contact. However, the distance is small enough that it is ensured at the same time that the atmosphere in chamber 22 cannot escape from this chamber 22.

Steam 28 is supplied to the chamber 22 through a supply line 26, as is shown in FIG. 1 by arrow Z. This steam 28 creates a moist atmosphere in chamber 22 which prevents drying out of the droplets and/or particles 12*a* on their journey from the spray nozzle 18 to the material web 14. This maintains a low viscosity of the coating medium 12, which is desirable for the formation of the coating layer 20, so that the droplets and/or particles 12*a* flow well after making contact with the material web surface 14*a*, thereby enabling them to form a coating layer 20 with a smooth surface. Beyond that, a part of the steam 28 precipitates on the material web 14 or the coating layer 20, thereby further aiding the flowability of the coating medium 12. This additional moistening of the material web 14 or the coating layer 20 can easily be tolerated, since material web 14 and/or coating layer 20 must be dried in any case following the coating process in the applicator device 10. The drying is necessary due to residual water that is in the material web 14 from the manufacturing process and/or the water serving as carrier liquid for the coating medium 12.

An amount of steam 28 must be supplied to the chamber 22 through supply line 26 which is consistent with that which has escaped from the chamber 22, due to condensation on the material web 14 and/or the coating layer 20 and due to the carry-along effects on the surface of the coating layer 20. The steam atmosphere prevailing in chamber 22 is therefore relatively stable. It specifically does not affect the spray jet of coating medium 12 emitted from spray nozzle 18 through turbulence, so that, moreover, the coating layer 20 is relatively uniform. In addition, the coating medium 12 can be applied by the spray nozzle 18 without, or substantially without, excess to the material web 14 (1:1 application). Thus, only leveling, not metering, of the coating layer 20 is necessary following the applicator device 10, viewed in flow direction L.

The coating medium 12 is supplied to the spray nozzle 18 through a supply line which connects to the longitudinal ends of spray nozzle 18, which are located in front or at the back of the plane of projection, viewed in cross direction Q of the arrangement. In addition, the housing 24 is equipped with an outlet line 30 at its lower end through which coating medium 12 which inadvertently does not reach the material web 14 and which has deposited itself on the walls of the housing 24, can be discharged from the chamber 22 (direction of arrow A).

Spray nozzle 18 is a single substance spray nozzle which atomizes the coating medium, for example through ultra sound.

Figure 2:
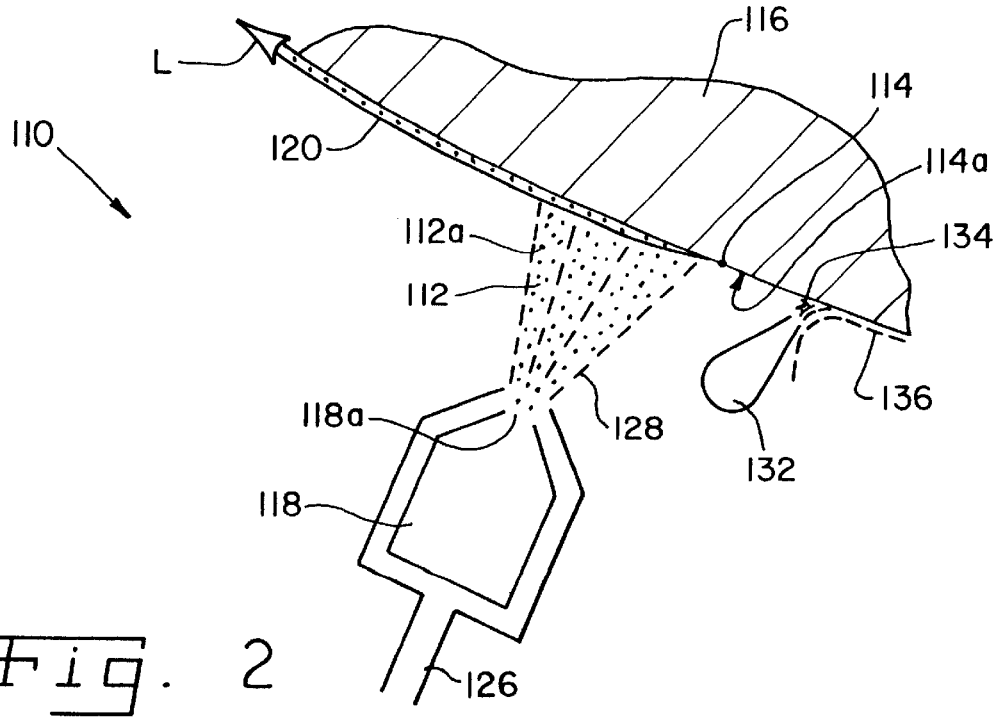
FIG. 2 is a schematic side view of another embodiment of an applicator device in accordance with the invention.

FIG. 2 illustrates another variation of the applicator device, according to the invention which, particularly in its operation, is consistent with the design form in FIG. 1. Therefore, the same components in FIG. 2 are identified with the same reference numbers as in FIG. 1, but increased by 100. Further, the embodiment according to FIG. 2 will be described only in as far as it differs from the embodiment illustrated in FIG. 1, and to the description of which we expressly refer.

The major difference of the applicator device 110 according to FIG. 2 compared to the applicator device 10 in FIG. 1 is that instead of a single substance spray nozzle 18, a two-substance spray nozzle 118 is utilized for spraying the coating medium 112. The coating medium 112 is ejected at an outlet opening 118*a* of the spray nozzle 118 where it is captured by the water steam 128 which is supplied through supply line 126, atomized and guided to the surface 114*a* of the material web 114 which is guided around roll 116, where it precipitates in the form of coating layer 120.

Maintenance of the moisture in the atomized coating medium droplets or particles 112*a* is ensured by the atomizing medium, that is, the steam 128, without the spray nozzle 118 being enclosed by a steam chest similar to housing 24 in FIG. 1. However, this does not preclude such a steam chest additionally being provided for the applicator device 110 illustrated in FIG. 2, especially in order to achieve a certain moisture level of material web 114 and the coating layer 120.

As a further measure in improving the coating result in the arrangement illustrated in FIG. 2, specifically when covering the material web 114 with the coating medium 112, a steam blower 132 is provided prior to the spray nozzle 118, viewed in flow direction L. Steam blower 132 is set at an acute angle against the surface 114*a* of material web 114, in opposite direction to the direction of rotation L of roll 116, similar to how a blade would be. The steam blower 132 blasts a steam jet 134, which "scrapes off" an air boundary layer 136 from the material web surface 114*a* which otherwise may impede coating of the material web 114 with the coating medium 112. Naturally, such a steam blower 132 may also be provided in the arrangement according to FIG. 1.

Figure 4:
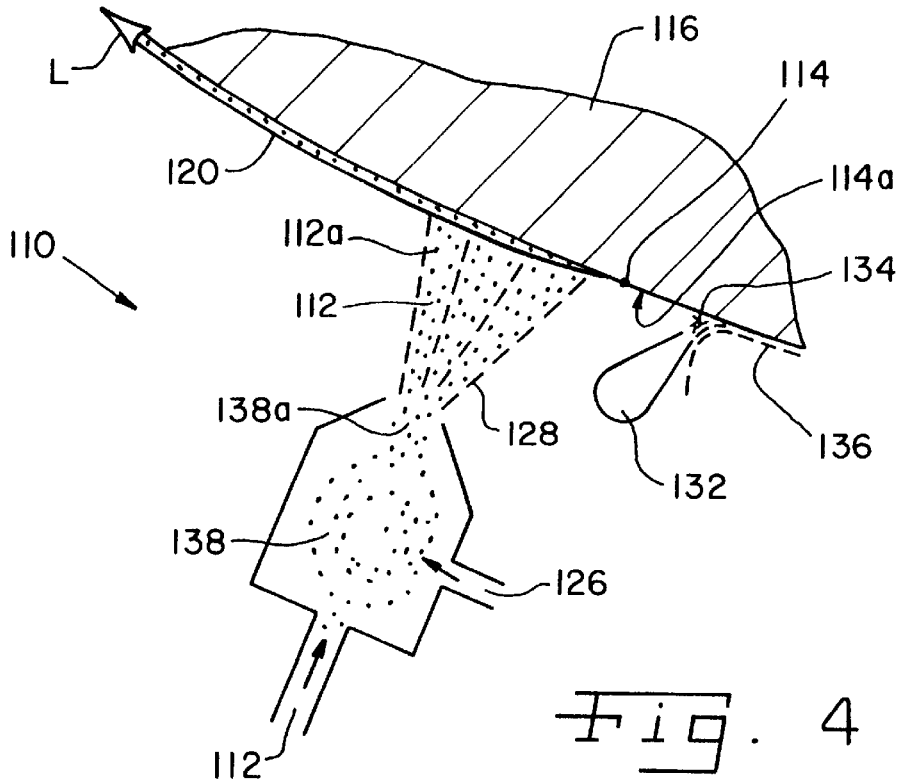
FIG. 4 is a schematic side view of a further embodiment of an applicator device in accordance with the invention.

Although according to FIG. 2 the spray nozzle 118 is illustrated in a rough schematic as a two-substance spray nozzle operating according to the external mixing principle, two-substance spray nozzles operating according to the internal mixing principle may also be utilized according to the invention, as shown by spray nozzle 138 (FIG. 4).

Figure 3:
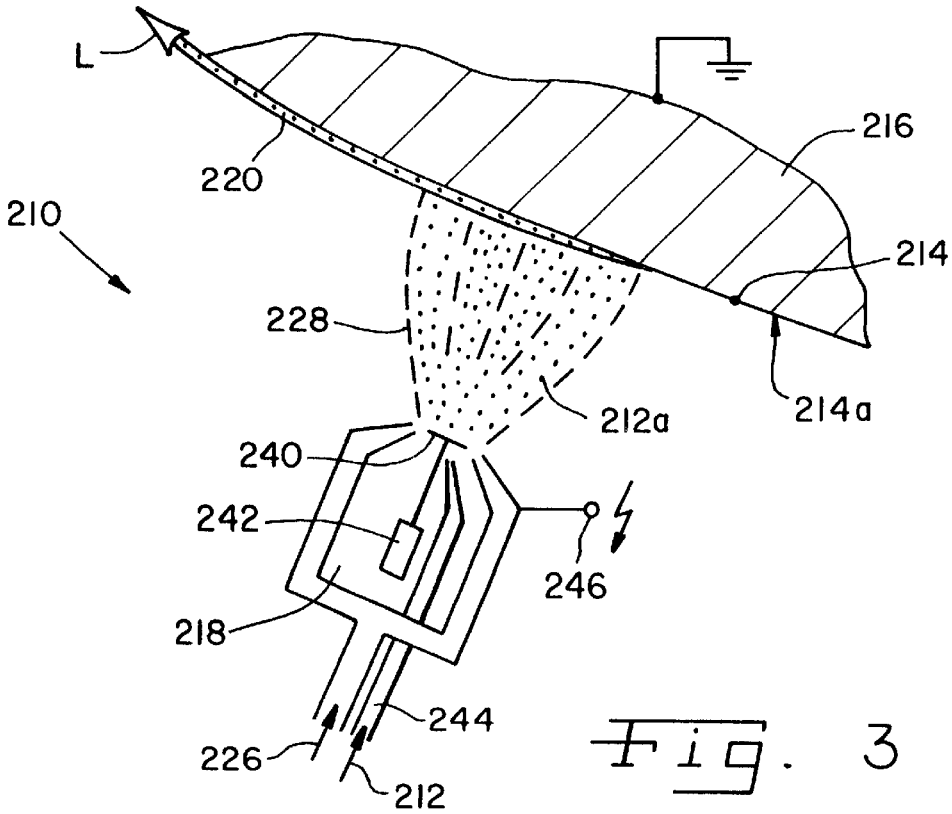
FIG. 3 is a schematic side view of yet another embodiment of an applicator device in accordance with the invention.

FIG. 3 illustrates a further embodiment of the applicator device according to the invention, which essentially is consistent with the embodiment in FIG. 1. Therefore, the same reference numbers are used in FIG. 3 for the same components as in FIG. 2, but are increased by an increment of 100, that is, compared with FIG. 2, increased by 200. Also, the embodiment according to FIG. 3 will only be described in as far as it differs from the embodiment illustrated in FIG. 2, the description of which we otherwise expressly refer to.

In the applicator device 210 illustrated in FIG. 3 a rotary spray nozzle 218 is utilized for coating of surface 214*a* of the material web 214 which is guided around the roll 216, instead of the two-substance spray nozzle which operates with steam atomization. The rotary spray nozzle 218 includes a spray disk 240 which is driven by motor 242 and rotates at high speed. The rotary spray element 240 is supplied via a supply line 244 with coating medium 212 which is being thrown radially toward the outside due to centrifugal forces, thereby being atomized. After the coating medium droplets 212*a* have left the spray element 240, they are picked up by a steam jet which is emitted in ring form around the spray element 240 and are diverted to the material web surface 214*a* where they deposit themselves in the coating layer 220.

Diversion of the radially thrown droplets and/or particles 212*a* may also be achieved with the assistance of electrostatic forces. In FIG. 3 this is suggested in that the spray nozzle 218 is connected with a high voltage source via a connection 246, while the roll 216 is connected to ground potential. This enables the droplets and/or particles 212*a* to be electrically charged during spraying and to be drawn to the material web surface 214*a* by the potential differential between nozzle 218 and roll 216.

Regarding the avoidance of drying out of the droplets 212*a* and/or their back moistening, reference is made to the relevant explanations, in their entirety, relating to the arrangement illustrated in FIG. 2.

Furthermore, the spray nozzle 218 in FIG. 3 may also be located in a steam box, similarly to FIG. 1. Finally, it is also feasible to remove the air boundary layer that is carried along by the material web 214 from the material web surface 214*a*, prior to the rotary spray nozzle 218, when viewed in flow direction L.

The fact that the coating medium according to the invention is supplied to the material web in a back-moistening and/or moistening atmosphere, thereby maintaining its flowability characteristics, has the further advantage of reducing the risk of caking of coating medium at the nozzle opening and the chamber walls. The device of the current invention, therefore, may be operated for long periods between subsequent maintenances and the down times required to carry out such maintenance are short.

With the coating method and/or the applicator device of the current invention, solid, powdery coating mediums can also be converted. It is the function of the steam to supply sufficient moisture to the atomized powder granules and the material web surface that the coating medium can flow to the desired extent after making contact with the material web.

Although the coating medium is applied directly to the material web in all three previously discussed design forms, it is also feasible for the coating medium to be applied to the surface of a transfer roll which then transfers the coating layer to the material web.

In addition to water, other mediums, for example toluol, are also suitable for the creation of a back-moistening and/or moistening atmosphere.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An apparatus for one of directly and indirectly applying a coating medium onto a moving fiber material web, said apparatus comprising:

a spray device having an application area, said spray device being configured for atomizing the coating medium;

a vapor supply device configured for maintaining an atmosphere of a moistening medium for the atomized coating medium in said application area of said spray device; and a chamber, said spray device being disposed within said chamber, said vapor supply device being configured for feeding said moistening medium into said chamber.

2. The apparatus of claim 1, wherein said spray device comprises a two-substance spray device configured for spraying the coating medium by use of said moistening medium.

3. The apparatus of claim 2, wherein said two-substance spray device comprises an internal mixing two-substance spray device.

4. The apparatus of claim 2, wherein said two-substance spray device comprises an external mixing two-substance spray device.

5. The apparatus of claim 1, wherein said spray device comprises a rotary spray device.

6. The apparatus of claim 5, wherein said moistening medium from said vapor supply device is configured for carrying the atomized coating medium to a moving surface having a direction of movement.

7. The apparatus of claim 6, further comprising a roll, said rotary spray device and one of the moving surface and said roll each being at a respective predetermined electrical potential voltage.

8. The apparatus of claim 7, further comprising a removal device disposed before said application area of said spray device relative to the direction of movement of the moving surface, said removal device being configured for using said moistening medium to remove an air boundary layer from the moving surface.

* * * * *